US010118077B2

(12) United States Patent
White

(10) Patent No.: US 10,118,077 B2
(45) Date of Patent: Nov. 6, 2018

(54) BELT CLIP DUAL CLEANING GOLF BRUSH WITH BALL MARKER

(71) Applicant: Louis Verdere White, Inver Grove Heights, MN (US)

(72) Inventor: Louis Verdere White, Inver Grove Heights, MN (US)

( * ) Notice: Subject to any disclaimer, the term of this patent is extended or adjusted under 35 U.S.C. 154(b) by 0 days.

(21) Appl. No.: 15/653,510

(22) Filed: Jul. 18, 2017

(65) Prior Publication Data

US 2018/0021644 A1 Jan. 25, 2018

Related U.S. Application Data

(60) Provisional application No. 62/363,909, filed on Jul. 19, 2016.

(51) Int. Cl.

| | |
|---|---|
| ***A63B 57/00*** | (2015.01) |
| ***A63B 57/60*** | (2015.01) |
| ***A46B 17/04*** | (2006.01) |
| ***A46B 15/00*** | (2006.01) |
| ***A46B 5/02*** | (2006.01) |
| ***A45F 5/02*** | (2006.01) |
| ***A63B 57/35*** | (2015.01) |
| ***A63B 57/30*** | (2015.01) |
| ***A46B 9/06*** | (2006.01) |

(52) U.S. Cl.

CPC ..... *A63B 57/60* (2015.10); *A45F 5/021* (2013.01); *A46B 5/02* (2013.01); *A46B 9/06* (2013.01); *A46B 15/0055* (2013.01); *A46B 15/0095* (2013.01); *A46B 17/04* (2013.01); *A63B 57/35* (2015.10); *A63B 57/353* (2015.10); *A45F 2200/0575* (2013.01); *A46B 2200/3073* (2013.01)

(58) Field of Classification Search

CPC ..... A45C 2013/306; A63B 57/00
USPC ..... 224/666, 667, 668, 673, 680
See application file for complete search history.

(56) References Cited

U.S. PATENT DOCUMENTS

| | | | | |
|---|---|---|---|---|
| 3,136,547 A * | 6/1964 | Schaper | A44B 11/001 | 473/406 |
| 3,233,802 A * | 2/1966 | Ludwick | A63B 47/001 | 224/183 |
| 3,298,579 A * | 1/1967 | Smith | A45F 5/021 | 224/183 |
| 3,674,189 A * | 7/1972 | Walbeck | A45C 11/00 | 206/223 |
| 3,819,095 A * | 6/1974 | Snyder | A63B 57/0032 | 224/248 |

(Continued)

*Primary Examiner* — Brian D Nash

(57) ABSTRACT

The portable golf club cleaning brush utilizes at least three releasable components; first, a compression clip carrying case that attaches to a belt or garment, with two sides, a front, a back, and bottom panels leaving the top of the case open. Second, the compact cleaning brush with a round easy grip handle all made of durable plastic. The brush pad has equally spaced rows of plastic bristles and equally spaced rows of soft metal bristles placed side by side on the same brush pad surface. The golf club cleaning brush is stored in the compression clip carrying case by sliding in from the top with the handle extending outside the case through a slot in the front panel of the case. Third, a disk magnet is centered and recessed from the outer surface of the round handle for the placement and securing a metal ball marker.

4 Claims, 3 Drawing Sheets

(56) References Cited

U.S. PATENT DOCUMENTS 3,923,215 A * 12/1975 Suzuki ..... A63B 57/207 224/183
4,081,114 A * 3/1978 Inoue ..... A45F 5/00 224/242
D252,422 S * 7/1979 Gillenwater ..... D3/221
4,325,504 A * 4/1982 Amani ..... A45F 5/00 224/170
4,736,877 A * 4/1988 Clark ..... A45F 5/021 206/315.1
4,974,763 A * 12/1990 Widrig ..... A63B 47/04 15/105
4,998,726 A * 3/1991 Budnick ..... A63B 57/00 116/223
5,025,966 A * 6/1991 Potter ..... A45F 5/02 224/183
5,419,551 A * 5/1995 Hoyt ..... A63B 57/00 15/4
5,857,600 A * 1/1999 Akutsu ..... A24F 15/12 224/183
5,934,530 A * 8/1999 Antczak ..... A63B 57/10 224/197
6,030,298 A * 2/2000 Tate ..... A63B 57/50 473/408
6,095,934 A * 8/2000 Ohama ..... A63B 57/207 224/918
6,173,451 B1 * 1/2001 DeVincenzi ..... A63B 57/207 2/161.2
6,193,121 B1 * 2/2001 Chang ..... A63B 57/00 206/315.5
6,202,911 B1 * 3/2001 Freer ..... A63B 47/001 224/223
6,220,973 B1 * 4/2001 Hsu ..... A63B 57/207 473/406
6,357,642 B1 * 3/2002 Marchessault ..... A42B 1/24 224/269
6,413,173 B1 * 7/2002 Muller ..... B26B 1/046 473/408
6,422,955 B1 * 7/2002 Lopez ..... A42B 1/24 224/918
6,571,997 B2 * 6/2003 Dedrick ..... A45F 5/00 224/183
6,691,905 B2 * 2/2004 Berdan ..... A45C 11/00 206/315.1
D504,769 S * 5/2005 Bozik ..... D3/221
7,766,769 B2 * 8/2010 Lueders ..... A63B 57/203 224/666
8,454,457 B1 * 6/2013 Woods ..... A63B 57/207 15/106
8,499,986 B2 * 8/2013 Knight ..... A45F 5/021 224/197
8,882,605 B1 * 11/2014 Lee ..... A63B 57/0087 15/209.1
2003/0019893 A1 * 1/2003 Decoteau ..... A45F 5/004 224/162
2010/0122709 A1 * 5/2010 Janatpour ..... A45F 5/00 132/286
2010/0129144 A1 * 5/2010 Osborne ..... A47J 43/288 403/291
2010/0193559 A1 * 8/2010 Van Huyssteen ..... A45C 1/04 224/680
2013/0104927 A1 * 5/2013 Hurst ..... A45D 19/0008 132/221

* cited by examiner

SECTION 2-2
SCALE 1.5 : 1

DETAIL B
SCALE 2 : 1

BELT CLIP DUAL CLEANING GOLF BRUSH WITH BALL MARKER

CLAIM OF PRIORITY

This patent application claims the benefit of priority of Louis White, U.S. Provisional Patent Application No. 62/363,909, entitled "Belt Clip Dual Cleaning Golf Brush with Ball Marker," filed on Jul. 19, 2016, which is hereby incorporated by reference herein in its entirety.

FIELD OF INVENTION

This invention relates to golf equipment accessories, specifically to accessories which are used for cleaning golf clubs.

BACKGROUND OF INVENTION

This invention relates to the field of golf accessories that relate to the field of cleaning golf club striking surfaces and grooves. Specifically, this invention comprises of cleaning dirt and debris from golf club irons, wedges, and fairway clubs during a round of golf, at the driving range, or general maintenance at home, and includes a metal ball marker. There are known brushes for the cleaning of golf club striking surfaces and grooves. Most are large in size with a long, bulky handle that is designed to attach primarily to a golf bag by a string, a chain, or a hook, the brush bristles are usually separated on opposite sides requiring the user to constantly flip the brush back and forth to use both brush bristle materials. These brushes are primarily used to clean golf clubs when standing next to a golf bag, limiting their usefulness during a round of golf when the bag is attached to a golf cart or not within reaching distance. Others brushes are designed to be placed into a pant pocket and requires you to remove from pants pocket, then extend and retract the brush bristles for use.

OVERVIEW—OBJECTS AND ADVANTAGES

The present invention comprises of a compact golf club cleaning brush with a dual set of brush bristles of different materials placed side by side on a single compact brush pad, this creates the ability to clean both the surface and grooves of imbedded dirt and debris at the same time without the need of flipping the brush back and forth to use the different bristle materials typically used for cleaning the surface and grooves of golf clubs. The compact brush pad has two sets of sturdy, durable brush bristles, one set with 3 rows of nylon or plastic material and one set with 3 rows of brass or soft metal material equally spaced, all bristles are placed on a single side of the compact brush pad. A round handle design is attached by a round stem on the opposite side of the brush pad bristles, the round handle protrudes through the front panel with a guiding slot and locking feature at the lower end of the guiding slot, this secures the cleaning brush into the clip-on protective carrying case by the round stem attaching the round handle to the brush pad, this makes it easy to grip the cleaning brush for removal and placement into the clip-on protective carrying case. The outer face of the round handle design secures the placement of a metal ball marker for easy access, use, and storage, held secure by a strong magnet placed into a pocket in the center of the round handle. A compact clip-on storage and protective carrying case is designed to attach on a variety of belt sizes or most garment waistlines. The clip-on storage and protective carrying case has 4 side walls and a bottom panel, leaving the top side open, this creates a box with a depth that encloses the entire compact brush pad and brush bristles. The front panel of the case has a guide slot to insert, center, and lock the cleaning brush when placed inside the case by the round stem of the brush that attaches the brush pad and round handle together. The back panel has a durable compression clip attached to the outer surface that allows the case to be clipped on a variety of belt sizes and most garment waistlines. This invention allows the golfer to have access to the cleaning brush at all times, anywhere on the golf course without the need of being next to a golf bag or digging out of a pant pocket. The compact cleaning brush also gives the golfer the ability to clean any dirt or debris from their golf club immediately after taking a practice swing and/or immediately before hitting the golf ball without having to return to the golf bag or golf cart.

SUMMARY

In accordance with the present invention, the dual head compact golf club cleaning brush can be used remotely from the golf bag and/or golf cart immediately when needed anywhere on the golf course with clear and easy access, combined with easy access to a metal ball marker. The present invention is designed in multiple colors with the ability to mix and match each of the components, the compact brush, the clip-on protective case, and the metal ball marker with an enamel color finish on one surface. This gives the present invention a modern and more fashionable design and look to the field of golf club cleaning brushes.

DETAILED DESCRIPTION OF THE INVENTION

Figure 1:
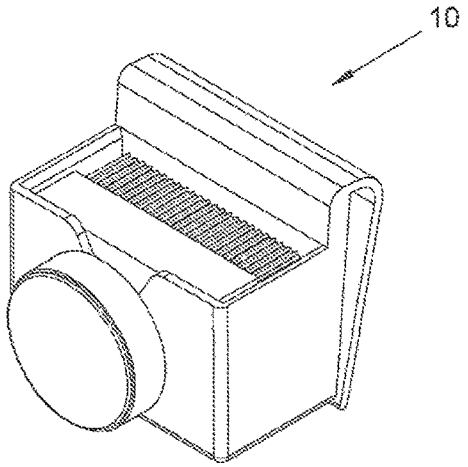
FIG. 1 is a perspective view, showing the embodiments in a complete and assembled state of the present invention.
Figure 2:
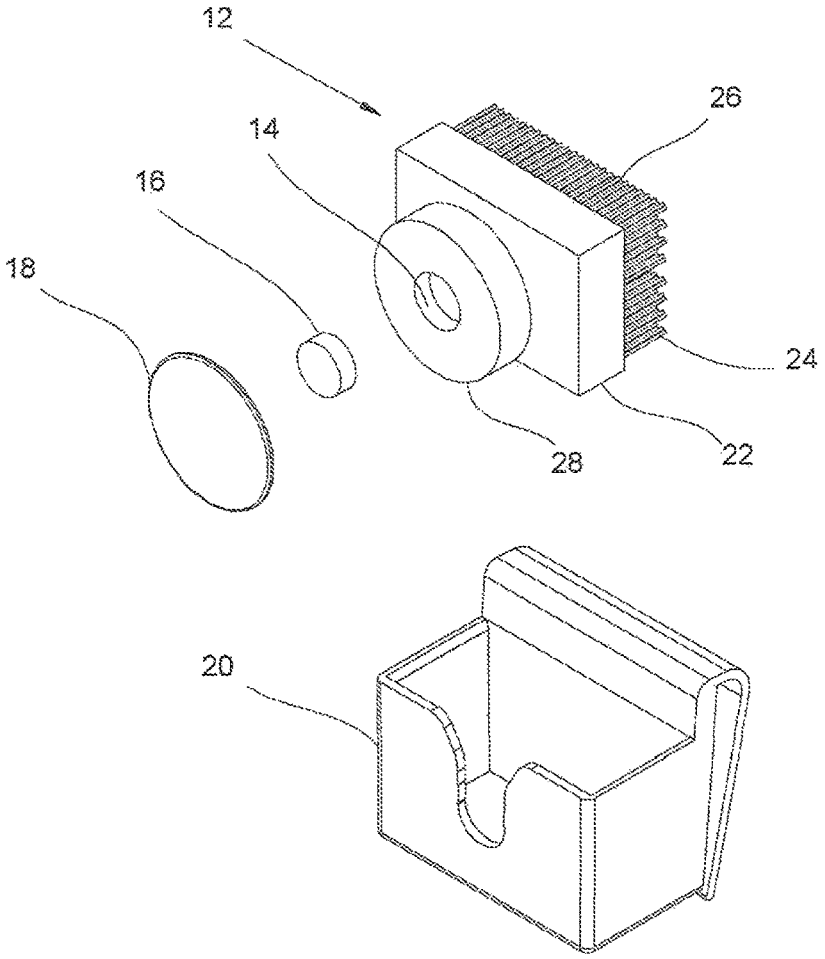
FIG. 2 is an exploded view, showing the embodiments and relationships of the clip-on storage and carrying case, dual bristle cleaning brush, ball marker and magnet which makeup the assembled present invention FIG. 1.
Figure 3:
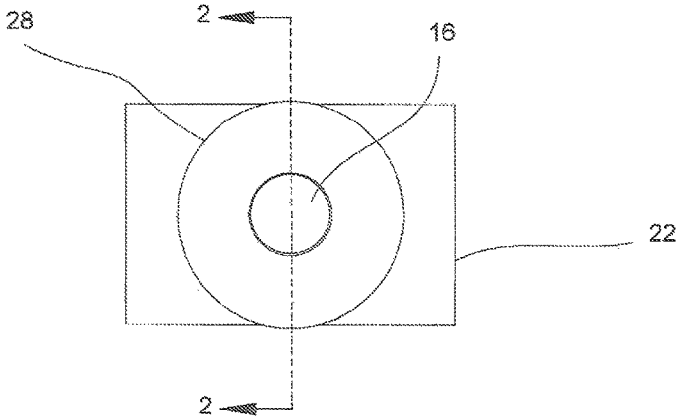
FIG. 3 is a front view of the embodiment, showing the dual bristle brush pad, round handle and magnet of the present invention.
Figure 4:
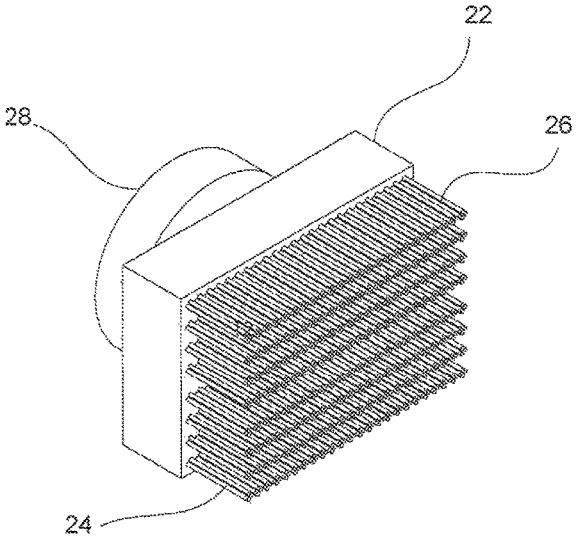
FIG. 4 shows a perspective view of the embodiment, showing the dual set of brush bristle rows, one set of nylon (plastic) bristle, and one set of brass (soft metal) bristle materials placed side by side on the same brush pad surface.
Figure 5:
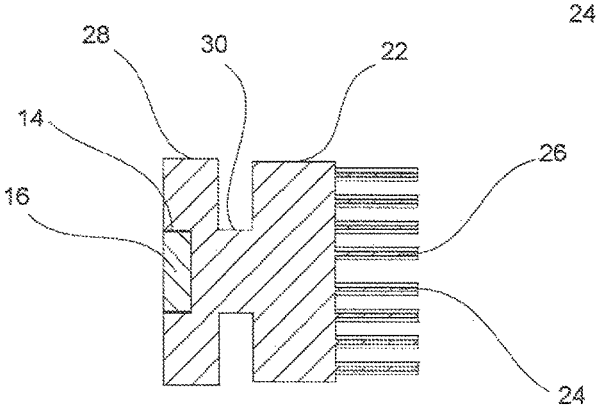
FIG. 5 is a cross-section view 2-2 of FIG. 3, showing the dual bristle brush pad, the round easy grip handle with guiding and locking stem, a strong magnet set into a pocket, and the dual bristle cleaning brush.
Figure 6:
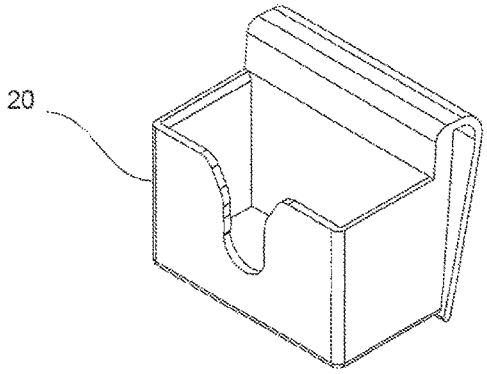
FIG. 6 is a perspective view of the embodiment, showing the clip-on storage and protective carrying case with attached clip.
Figure 7:
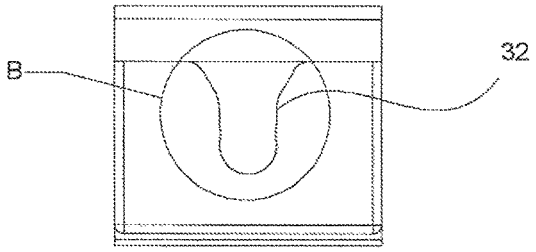
FIG. 7 is a front view of the embodiment FIG. 6, showing the clip-on storage and protective carrying case with guiding slot and locking tabs for brush placement.
Figure 8:
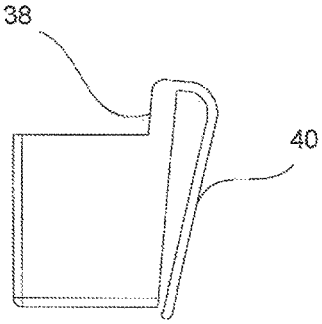
FIG. 8 is a side view of the embodiment FIG. 6, showing the clip-on storage and protective carrying case with attached compression belt clip to secure case for use on a belt, a waistline, or other placements of choice.
Figure 9:
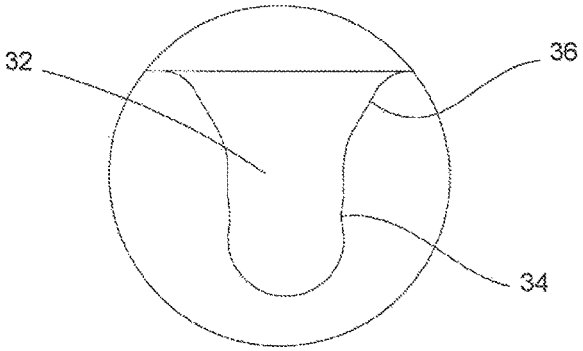
FIG. 9 is a front detail view of FIG. 7, showing the details of the tapered guiding slot with locking tabs on the lower portion of slot to set and secure the dual bristle cleaning brush into the clip-on storage and protective carrying case.

FIGS. 1 and 2 shows all the main embodiments of the present invention. FIG. 1 shows the present invention 10, with all the embodiments in a complete assembled state. FIG. 2 shows an exploded view of all the embodiments of the present invention 10, the golf club dual bristle cleaning brush 12, comprised of the dual bristle brush pad 22, the round easy grip handle 28, the nylon or plastic brush bristles 24, the brass or soft metal brush bristles 26, the magnet pocket 14, the magnet 16, the ball marker 18, and clip-on storage and protective carrying case 20. FIG. 3 shows a front view of the embodiment of the golf club dual cleaning brush 12, the dual bristle brush pad 22, the round easy grip handle 28, and strong magnet 16, of the present invention. FIG. 4 shows a perspective view of embodiment of the golf club dual cleaning brush 12, the easy grip round handle 28, the compact brush pad 22, with recessed chambers to set and secure all brush bristle 24 and 26, in equally spaced rows on the same surface of the brush pad 22, opposite the easy grip round handle 28. FIG. 5, shows a cross-section view 2-2 of FIG. 3, showing the round easy grip handle 28, with a magnet pocket 14, the ball marker securing magnet 16, set into the centered pocket 14, of the easy grip handle 28. The guiding and locking stem 30, the compact dual bristle brush pad 22, the nylon (plastic) brush bristles 26, and the brass (soft metal) brush bristles 24. FIG. 6 shows a perspective view of the embodiment of the clip-on storage and protective carrying case 20. FIG. 7 shows a front view of the embodiment of FIG. 6, and the dual bristle cleaning brush guiding and locking placement slot 32. FIG. 8 shows a side view of the embodiment of FIG. 6, the dual bristle brush protective back panel 38, and the press-on storage and protective carrying case compression clip 40. FIG. 9 shows the DETAIL-B view of the embodiment of FIG. 7, showing the guide slot 32, the tapered lead in slides 36, for easy placement and centering of the dual bristle cleaning brush 12, the locking tabs 34, to secure the dual bristle cleaning brush 12, into the clip-on storage and protective carrying case 20, keeping the dual bristle cleaning brush secure before, during, and after use.

The invention claimed is:

1. A portable golf club cleaning apparatus comprising: a) a compact clip on carrying case; b) a compact dual bristle brush; c) a magnet; and d) a metal ball marker with at least 1 side that may be of custom color;

wherein said clip on compact carrying case comprising a base, 4 sides connected at said base with the top side open, 2 sides at opposite ends of said 4 sides may be shorter in length;

the front panel of said 4 sides has a vertical slot in the center with one end at the top of said front panel, and opposite end of said slot towards said base, the end of said slot at the top of said front panel opens outwards to form a wide slanted funnel at the top of said front panel for guiding and centering of said compact dual bristle brush into said compact clip on carrying case;

the opposite end of said slot near said base has two protruding nipples opposite one another at the width of said slot placed at a distance upward from the radius of said slot near said base, said nipples grip and secure said compact dual bristle brush when placed in said compact clip on carrying case;

wherein said back panel of said 4 sides is molded with said flexible pressure clip on the outer surface expanding the length of said back panel, the said flexible pressure clip flexes for adjustments while maintaining a compressed hold to a variety of material thicknesses;

said 4 sides connected at said base creates the enclosure of said compact clip on carrying case.

2. The apparatus of claim 1; wherein said compact clip on carrying case, said compact dual bristle brush, and 1 side of said metal ball marker comprises of custom colors that are interchangeable.

3. A portable golf club cleaning apparatus comprising: a) a compact clip on carrying case; b) a compact bristle brush; c) a magnet; and d) a metal ball marker with at least 1 side that may be of custom color; wherein said compact dual bristle brush is made of molded plastic, comprising a compact brush pad, nylon and brass bristles, a round handle, and short standoff attaching said round handle to said compact brush pad; wherein said compact brush pad has equally spaced rows of said nylon bristles grouped together and equally spaced rows of said brass bristles grouped together where both groups are placed side by side covering one surface of said compact brush pad, said compact brush pad surface opposite said nylon and brass bristles attaches said round handle by said short standoff creating space between said compact brush pad and said round handle; wherein said short standoff enters said slanted guide slot in front panel of said compact clip on carrying case, said round handle attached to said short standoff remains outside said case at a set spacing between said compact brush pad and said round handle; wherein said magnet is centered and recessed in said round handle held in place by a type of adhesive; wherein said metal ball marker is placed and centered on the outer face of said round handle secured by said magnet.

4. The apparatus of claim 3; wherein said compact clip on carrying case, said compact dual bristle brush, and 1 side of said metal ball marker comprises of custom colors that are interchangeable.

* * * * *